US010323802B2

(12) United States Patent
Zheng et al.

(10) Patent No.: US 10,323,802 B2
(45) Date of Patent: Jun. 18, 2019

(54) ROTATABLE POCKET LAMP HAVING DUAL LED LIGHT ELEMENTS

(71) Applicant: Alliance Sports Group, L.P., Grand Prairie, TX (US)

(72) Inventors: Shenjie Zheng, Hangzhou (CN); Jimmy Prieto, Grand Prairie, TX (US)

(73) Assignee: Alliance Sports Group, L.P., Grand Prairie, TX (US)

( * ) Notice: Subject to any disclaimer, the term of this patent is extended or adjusted under 35 U.S.C. 154(b) by 0 days.

(21) Appl. No.: 15/730,711

(22) Filed: Oct. 11, 2017

(65) Prior Publication Data

US 2019/0017662 A1 Jan. 17, 2019

(30) Foreign Application Priority Data

Jul. 14, 2017 (CN) ..... 2017 2 0853199 U

(51) Int. Cl.

| | |
|---|---|
| ***F21L 4/02*** | (2006.01) |
| ***F21L 4/04*** | (2006.01) |
| ***F21V 21/088*** | (2006.01) |
| ***F21V 21/108*** | (2006.01) |
| ***F21Y 115/10*** | (2016.01) |

(52) U.S. Cl.

CPC ..... *F21L 4/027* (2013.01); *F21L 4/045* (2013.01); *F21V 21/0885* (2013.01); *F21V 21/108* (2013.01); *F21Y 2115/10* (2016.08)

(58) Field of Classification Search

CPC ... F21L 4/005; F21L 4/02; F21L 4/022; F21L 4/027; F21L 4/04; F21L 4/045; F21V 21/0885

See application file for complete search history.

(56) References Cited

U.S. PATENT DOCUMENTS

| | | | | |
|---|---|---|---|---|
| 2,401,366 A * | 6/1946 | Muldoon | ..... | F21L 4/045 362/199 |
| 5,163,751 A * | 11/1992 | Bottiglieri | ..... | F21L 14/02 362/376 |
| 6,056,414 A * | 5/2000 | Krieger | ..... | F21L 2/00 362/184 |
| 6,361,184 B1 * | 3/2002 | Hallgrimsson | ..... | F21L 4/04 362/188 |

(Continued)

FOREIGN PATENT DOCUMENTS

CN 202580670 U 12/2012

*Primary Examiner* — Alexander K Garlen

(74) *Attorney, Agent, or Firm* — Thorpe North & Western LLP

(57) ABSTRACT

A pocket LED light includes a cylindrical lamp body, a pen clip provided on the lamp body, a power supply provided in the lamp body, a light emitting module electrically connected with the power supply, a rotating shaft and a hook. The light emitting module is located on the side opposite to the pen clip, and the light emitting module includes an LED main light element provided on the exterior and an LED light element provided on a face of a protruding end. The rotating shaft is vertically provided in the lamp body and rotatable within the lamp body. The light emitting module is hinged to an end of the rotating shaft extended beyond the lamp body. One end of the hook is rotatably provided at the bottom of the lamp body and the lamp body is provided with a slot which matches with the hook.

11 Claims, 6 Drawing Sheets

(56) References Cited

U.S. PATENT DOCUMENTS

| | | | | |
|---|---|---|---|---|
| 7,591,572 | B1 * | 9/2009 | Levine | A47F 11/10 362/191 |
| 9,541,244 | B1 * | 1/2017 | Berezinski | F21L 4/022 |
| 2004/0114357 | A1 * | 6/2004 | Dalton | F21L 4/04 362/190 |
| 2007/0014103 | A1 * | 1/2007 | Teng | F21L 4/027 362/157 |
| 2007/0058365 | A1 * | 3/2007 | Anderson | F21L 4/04 362/198 |
| 2009/0290335 | A1 * | 11/2009 | Levine | F21V 17/007 362/220 |
| 2012/0033415 | A1 * | 2/2012 | Sharrah | F21L 4/027 362/199 |
| 2015/0131276 | A1 * | 5/2015 | Thompson | F21L 4/025 362/191 |
| 2015/0276188 | A1 * | 10/2015 | Osborn | F21V 21/0885 362/106 |
| 2017/0205058 | A1 * | 7/2017 | Ostrander | F21V 21/0885 |

* cited by examiner

ROTATABLE POCKET LAMP HAVING DUAL LED LIGHT ELEMENTS

CROSS REFERENCE TO RELATED APPLICATIONS

The present application claims the benefit of Chinese Patent Application No. 201720853199.1 filed on Jul. 14, 2017. All the above are hereby incorporated by reference.

FIELD

The present application relates to a lighting fixture, in particular, a pocket LED light made into the shape of a pen.

BACKGROUND

Chinese patent with patent no. 201220182963.4 discloses "a penlight", including a cylindrical housing, a power supply installed within the housing, and a light emitting element connected with the power supply, characterized in that: the upper side of the housing is vertically provided with a slit, the slit is provided with a holder for mounting the light emitting element, the light emitting element is disposed on the holder, extending beyond the exterior of the housing, on the outside of the light emitting element is provided with a transparent cover, and on the side of the housing opposite to the light emitting element is provided with a rotatable pen clip. This kind of lighting fixture having structure and appearance similar to pens is easy to carry and the angle of illumination is adjusted using the rotatable pen clip. However, there are also a few problems: firstly, this kind of penlight is equipped with light emitting element only on the side of the housing but no headlights, so it has limited angles of illumination and cannot be used as a flashlight; secondly, this kind of penlight can only be fixed by the pen clip for use, and its uses are greatly restricted.

SUMMARY

The objective of the present application is to design a pocket LED light with wide range of lighting and adjustable angles, which can transform into various modes of use to apply to various environments.

The pocket LED light includes a cylindrical lamp body, a pen clip provided on the lamp body, a power supply provided in the lamp body and a light emitting module connected with the power supply, a rotating shaft, a stopper and a hook; wherein the light emitting module is located on a side of the lamp body opposite to the pen clip, and the light emitting module includes an LED main light element provided on an exterior of the light emitting module and an LED light element provided on a face of a protruding end of the light emitting module; the rotating shaft is vertically provided in the lamp body and rotatable within the lamp body; the light emitting module is hinged to an end of the rotating shaft extended beyond the lamp body; and one end of the hook is rotatably provided at a bottom of the lamp body and the lamp body is provided with a slot which matches with the hook, the stopper is provided at the bottom of the lamp body, obliquely above the hinge joint of the hook.

In an embodiment, a side of the lamp body opposite to the light emitting module may include an opening provided with a rear cover and the pen clip may be provided on the rear cover.

In another embodiment, the LED main light element and the LED light element may be provided in an upper cover and a lower cover of the light emitting module, the LED main light element may include a PCB circuit board, a COB light source electrically connected with the PCB circuit board, and a reflective cup provided above the COB light source; the reflective cup may be located below the upper cover and a transparent cover may be provided on the upper cover, at a position corresponding to the reflective cup; the LED light element may be mounted on the face of the protruding end of the light emitting module, and the LED light element may include an LED lamp bead and a lens located on an exterior of the LED lamp bead; and the LED lamp bead may be electrically connected with the PCB circuit board. The pocket LED light may further include a pair of buckles separately provided at the side of the lamp body opposite to the pen clip.

In a further embodiment, the LED main light element and the LED light element may be provided in an upper cover and a lower cover of the light emitting module, the LED main light element may include a PCB circuit board, a COB light source electrically connected with the PCB circuit board, and a reflective cup provided above the COB light source; the reflective cup may be located below the upper cover and a transparent cover may be provided on the upper cover, at a position corresponding to the reflective cup; the LED light element may be mounted on the face of the protruding end of the light emitting module, and the LED light element may include an LED lamp bead and a lens located on an exterior of the LED lamp bead; and the LED lamp bead may be electrically connected with the PCB circuit board. The pocket LED light may further include a pair of buckles separately provided at the side of the lamp body opposite to the pen clip.

In yet another embodiment, the pocket LED light may further include a magnet provided at the bottom of the lamp body.

Compared with the prior art, the present application has the following beneficial effects: first, the design of the rotating shaft provided on the lamp body, the light emitting module hinged to the rotating shaft, the bottom of the lamp body rotatably provided with a hook and the bottom of the lamp body provided with a stopper allows the rotating shaft to drive the light emitting module to rotate on the lamp body and the light emitting module to turn around the rotating shaft and unfold at 180 degrees while in concert with swinging the hook open so that the light emitting module can, under the action of the rotating shaft, freely rotate on the lamp body and, by adjusting the angle and the position between the light emitting module and the lamp body according to the specific environment and requirements of use and rotating the hook to be perpendicular to or at 180 degrees with the lamp body, achieve modes of the light, such as handheld mode, stand-alone hand-free mode, and hanging hand-free mode, adjust the angle of illumination, widen the range of lighting, and be transformed into various modes of use to apply to various environments. Second, for the design of the light emitting module having an LED main light element on the exterior and an LED light element on a face of a protruding end, both the LED main light element and the LED light element are designed to be in the light emitting module for easy management, and, at the same time, the LED light element on the face of the end can be used as a headlight, i.e. as a flashlight, when the light is in the handheld mode. Third, for the design of a pen-shaped lamp body and the rear cover of the lamp body provided with a pen clip, on one hand, the light can be inserted into coat pockets through the pen clip, both convenient to carry and use in hand-free working environments; on the other hand, the pen clip is designed to be on the rear cover and either be integrated or not integrated with the rear cover so that after the pen clip is damaged due to prolonged use, the rear cover or the pen clip can be replaced directly to save large amount of resources. Fourth, for the design of the buckle provided on the lamp body which fits with the light emitting module, when the light emitting module is folded, it can be firmly engaged with the lamp body with the design of the buckle for easier carrying. Fifth, the design of the magnet provided at the bottom of the lamp body allows the light to be attached to metal surfaces and, by rotating the light emitting module, to fulfill the needs of various angles of illumination and widen the scope of uses.

BRIEF DESCRIPTIONS OF THE DRAWINGS

DETAILED DESCRIPTION

Figure 1:
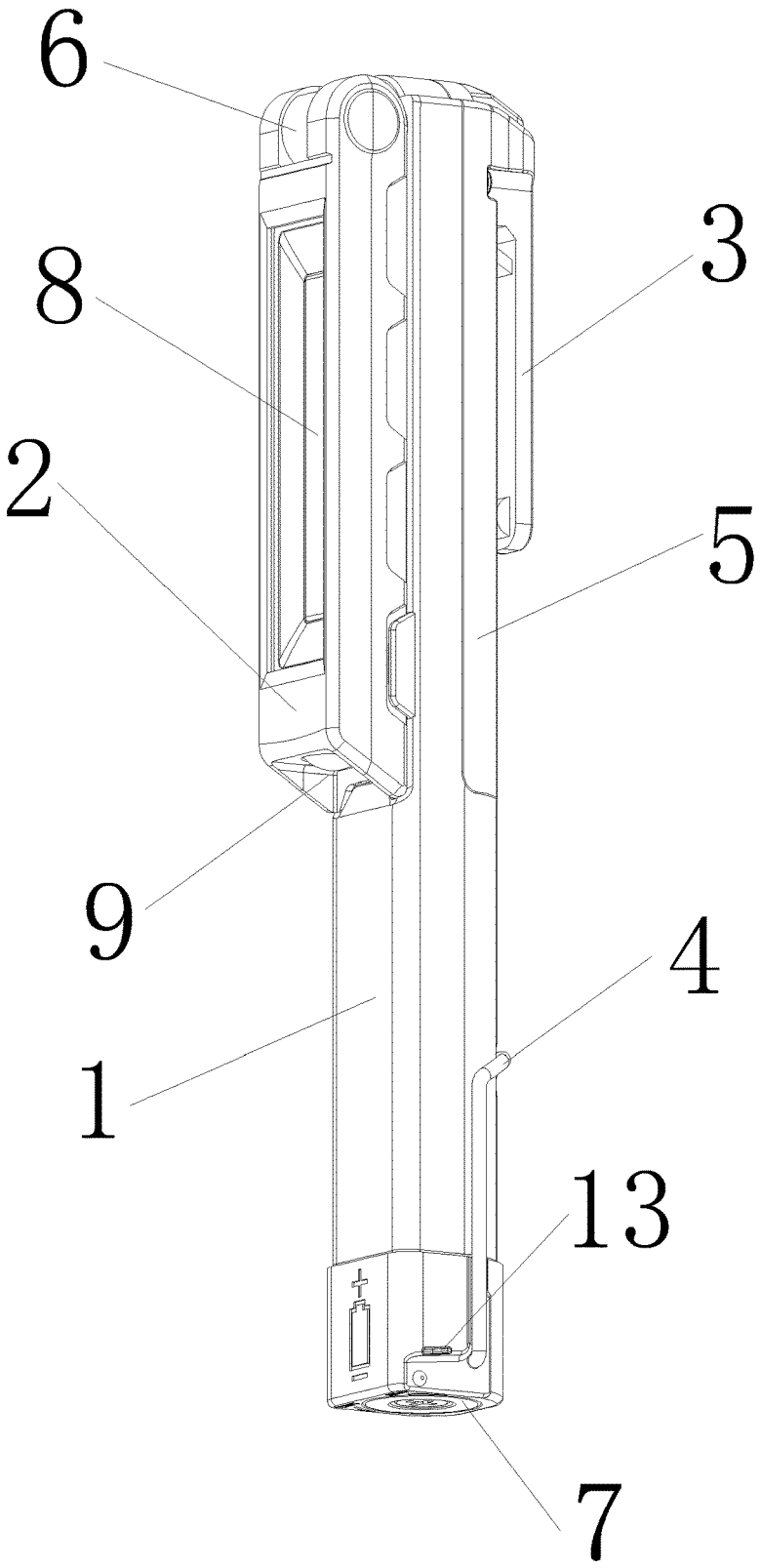
FIG. 1 is a schematic perspective view of the pocket LED light of the present application.
Figure 2:
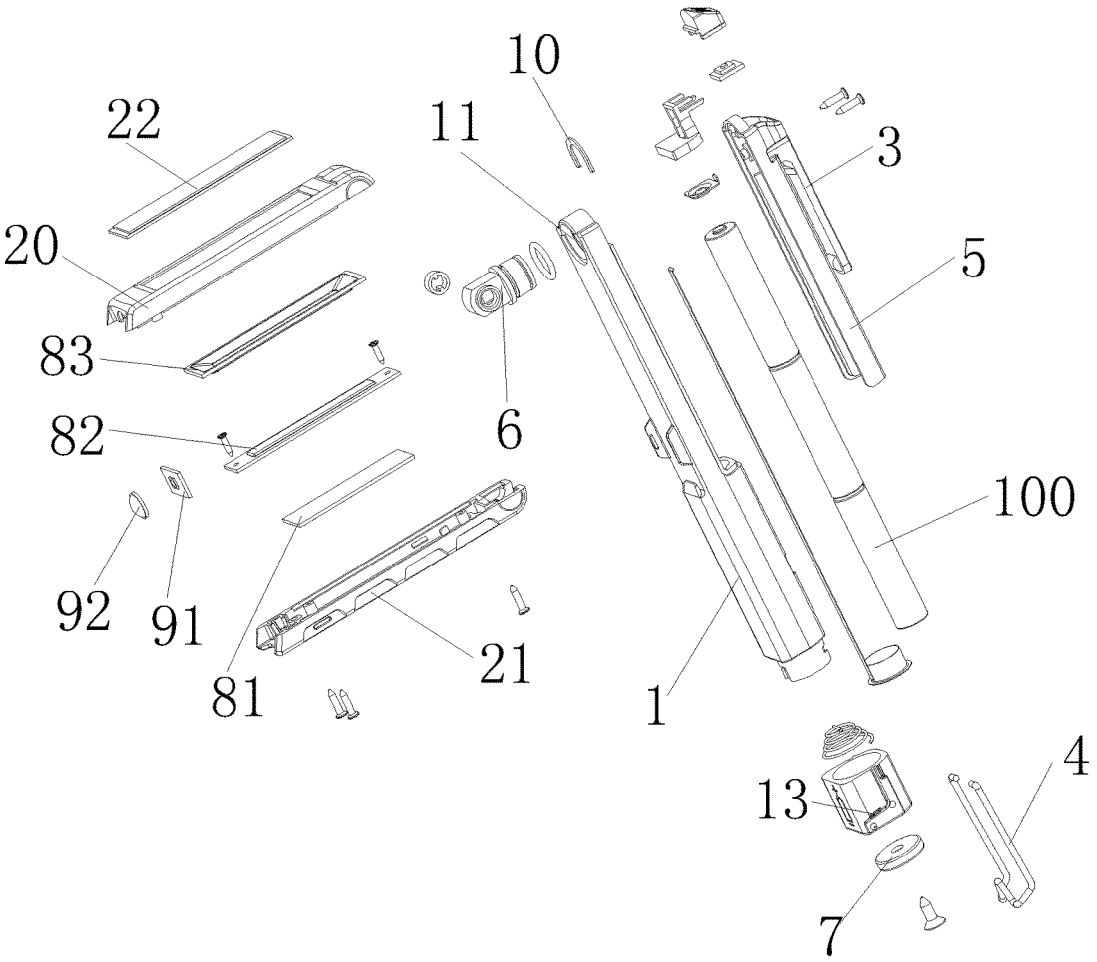
FIG. 2 is a schematic exploded view of FIG. 1.

To make the technical solution of the present application clearer, the present application will be described in detail with reference to FIGS. 1-6. It should be understood that specific embodiments described in the present specification are merely for purposes of explanation and are not intended to limit the scope of the present application.

The present application is directed to a pocket LED light, including a cylindrical lamp body 1, a pen clip 3 provided on the lamp body 1, a power supply 100 provided in the lamp body 1, a light emitting module 2 electrically connected with the power supply 100, a rotating shaft 6 and a hook 4. The side of the lamp body 1 opposite to the light emitting module 2 comprises an opening provided with a rear cover 5 and the pen clip 3 is provided on the rear cover 5, the pen clip 3 may be integrated with the rear cover 5 and may also form a buckle-connected split structure with the rear cover 5. The light emitting module 2 is located on the side opposite to the pen clip 3, and the light emitting module 2 includes an LED main light element 8 provided on the exterior and an LED light element 9 provided on a face of a protruding end. The rotating shaft 6 is vertically provided in the lamp body 1 and rotatable within the lamp body 1, the light emitting module 2 is hinged to an end of the rotating shaft 6 extended beyond the lamp body. Specifically, the rotating shaft 6 is inserted into a through hole 11 provided on the lamp body 1, the through hole 11 is located at the head position on the opening side of the lamp body 1, and the end of the rotating shaft 6 passing through the through hole 11 is provided with an opening stop pin 10 such that the rotating shaft 6 can rotate in the through hole 11 while the other end of the rotating shaft 6 is hinged to the light emitting module 2 so that the rotating shaft 6 can drive the light emitting module 2 to rotate on the lamp body 1 and the light emitting module 2 can turn around the rotating shaft 6 and unfold at 180 degrees and, by adjusting the angle and the position between the light emitting module 2 and the lamp body 1 according to the specific environment and requirements of use, adjust the angle of illumination, widen the range of lighting, and be transformed into various modes of use to apply to various environments. One end of the hook 4 is rotatably provided at the bottom of the lamp body 1, and the lamp body 1 is provided with a slot which matches with the hook 4, the bottom of the lamp body 1 obliquely above the hinge joint of the hook 4 is provided with a stopper 13 so that the hook 4 can be rotated to be perpendicular to or at 180 degrees with the lamp body 1. When the hook 4 is rotated to be perpendicular to the lamp body 1, under the action of the stopper 13, the light can, with the hook 4 as a base, maintain a stand-alone mode, achieve operating modes of the light, such as a handheld mode, stand-alone hand-free mode, and hanging hand-free mode, is easy to use, and has a wide range of applications.

Figure 3:
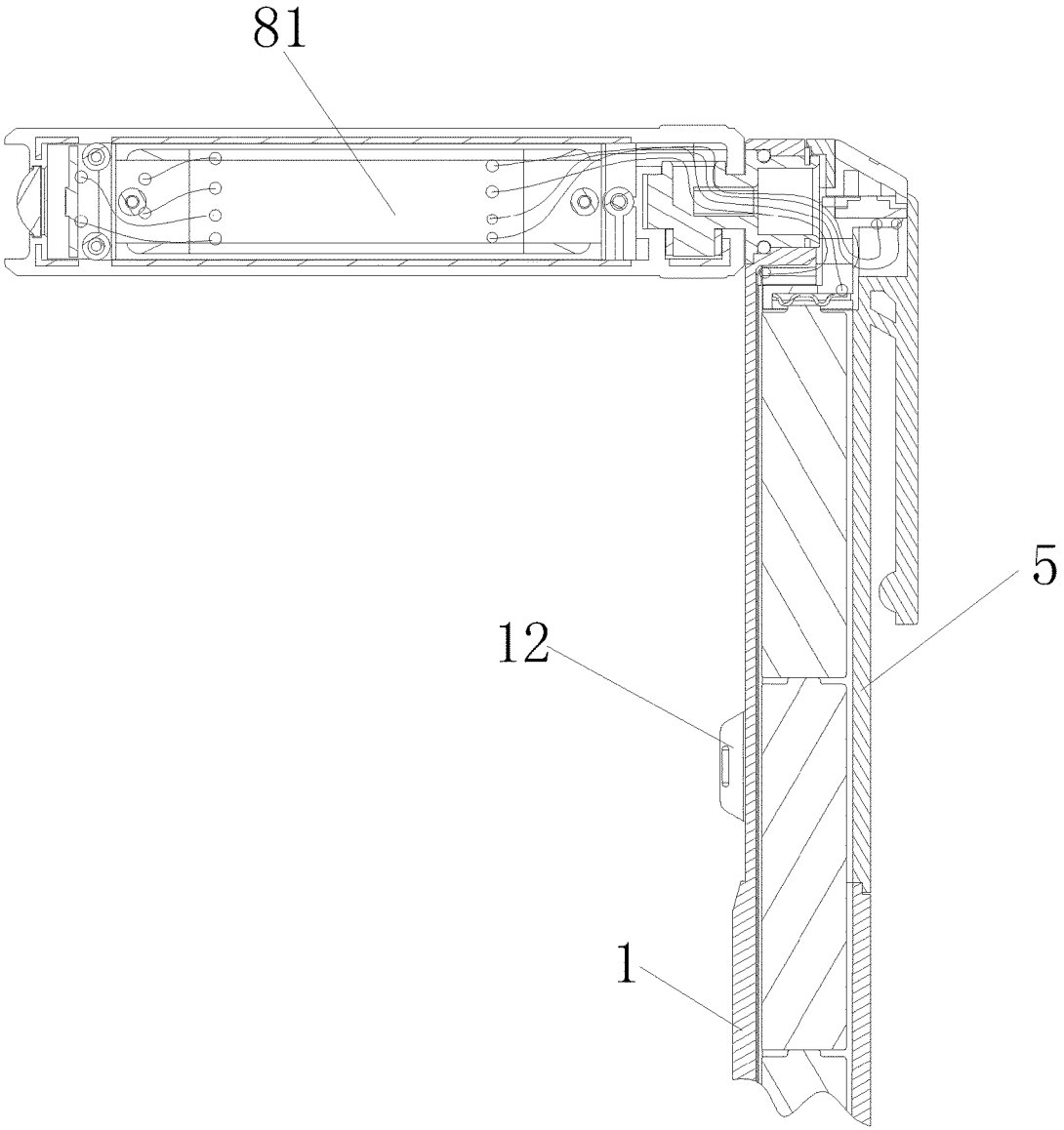
FIG. 3 is a schematic cross-sectional view of the pocket LED light of the present application.

The specific structures of the above light emitting module 2, the LED main light element 8 and LED light element 9 are known in the art and their structures are diversified. For instance, the light emitting element of "the penlight" described in the background technology is hereby merely a structure proposed in an embodiment, but is not limited to such a structure. The light emitting module 2 includes the LED main light element 8, the LED light element 9, an upper cover 20 and a lower cover 21. The LED main light element 8 and the LED light element 9 are provided in the upper cover 20 and the lower cover 21 of the light emitting module 2, the LED main light element 8 includes a PCB circuit board 81 provided in the lower cover 21, a COB light source 82 electrically connected with the PCB circuit board 81, and a reflective cup 83 provided above the COB light source 82. The PCB circuit board 81, the COB light source 82, and the reflective cup 83 mentioned herein are known in the art and are not described here. The reflective cup 83 is located below the upper cover 20 and a transparent cover 22 is provided on the upper cover 20, at a position corresponding to the reflective cup 83. The light of the COB light source 82 passing through the reflective cup 83 and the transparent cover 22 acts as the main light source of the lamp body to achieve floodlighting. The LED light element 9 is mounted on the face of the protruding end of the light emitting module 2 and is fixed by the upper cover 20 and the lower cover 21, and the LED light element 9 is composed of an LED lamp bead 91 and a lens 92 located on the exterior of the LED lamp bead 91. The LED lamp bead 91 is electrically connected with the PCB circuit board 81. The light of the LED lamp bead 91, with the action of the lens 92, acts as an auxiliary light of the lamp body and achieve the role of spotlighting. When the light emitting module 2 is flipped over and unfolded to the handheld mode, the LED light element 9 acts as a headlight so that the light can be used as a flashlight. The LED main light element 8 and the LED light element 9 are all electrically connected with the PCB circuit board 81, so that it is easy to manage and saves much more space and resources. FIG. 3 shows the circuit wire connection between the PCB circuit board 81 and the respective elements, but the present application is not limited to this structure.

The abovementioned rotating shaft 6 and the lamp body 1 may be designed as a structure that the rotating shaft 6 can rotate by only 180 degrees. That is, at the through hole 11 of the lamp body 1 on the side the light emitting module 2 is provided with a semicircular annular groove, and the rotating shaft 6 is provided with a stopper block corresponding thereto. This structure is known in the art and is not described here. A pair of buckles 12 is separately provided on the lamp body 1 at the side of the light emitting module 2, and the buckles 12 fit with the lower cover 21. Specifically, on the lamp body 1 at the side of the light emitting module 2 may form a concave shape so that the light emitting module 2 can be aligned with the lamp body 1 when it is folded. On the lamp body 1 at that side is separately provided with a pair of buckles 12 and the buckles 12 can engage and fit with the edges of the lower cover 21 so that, when the light emitting module 2 is turned back to the lamp body 1, it can be firmly engaged with the lamp body 1 for easier carrying and use. At the bottom of the lamp body 1 is provided with a magnet 7 so to attach the light to metal surfaces by the magnet 7 and, by rotating the light emitting module, to fulfill the needs of various angles of illumination and widen the scope of uses. In addition, the light can also be designed as a mini type of small size for easier carrying and use.

Figure 4:
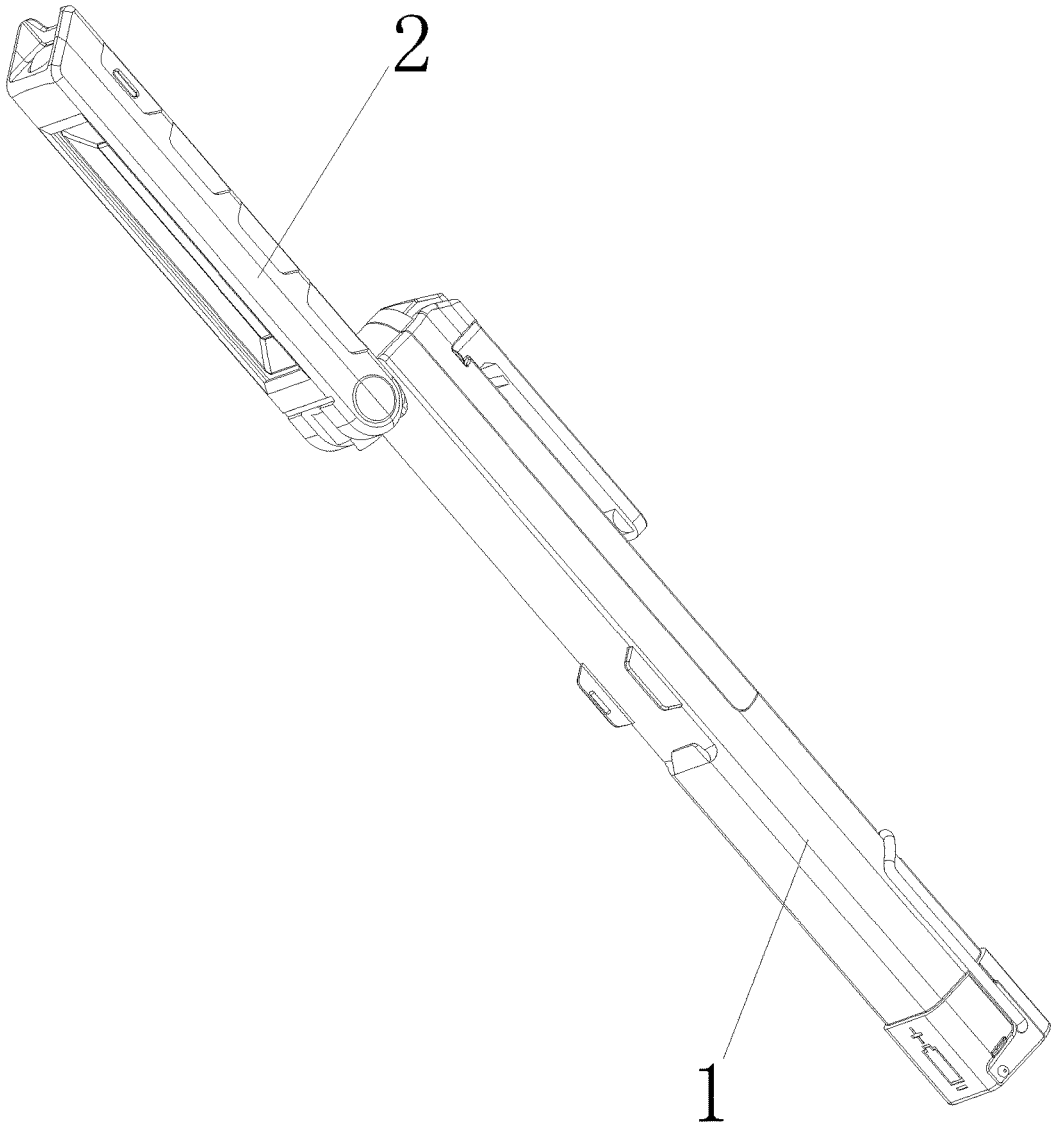
FIG. 4 is a schematic perspective view of the pocket LED light of the present application in a handheld mode.

Handheld Mode Operating Status: Referring to FIG. 4, the light emitting module is flipped over and unfolded to disengage from the buckles, and then rotated 180 degrees while flipping until the light emitting module forms a handheld mode with the lamp body. The LED light element acts as a headlight, which can be used as a flashlight mode, i.e. a handheld mode.

Figure 5:
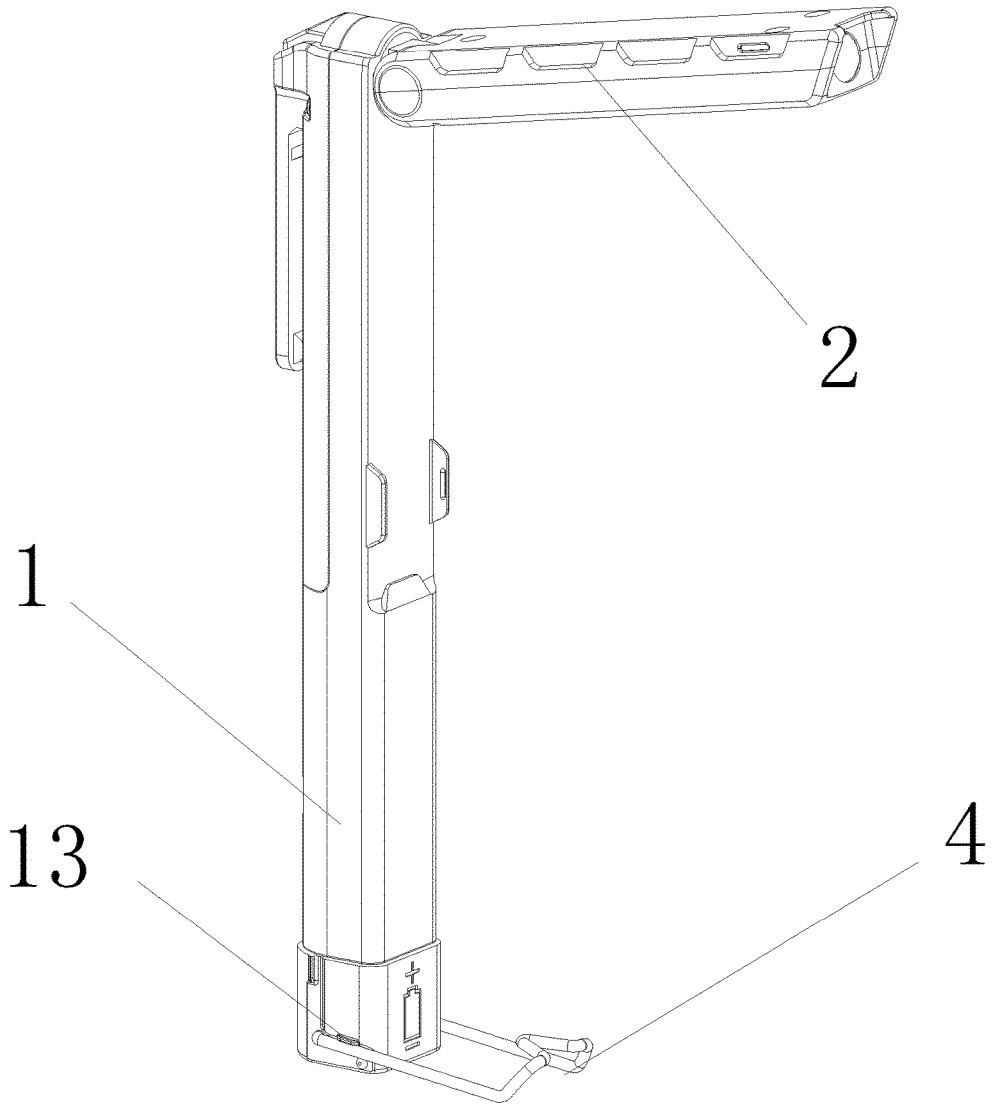
FIG. 5 is a schematic perspective view of the pocket LED light of the present application in a stand-alone hand-free mode.

Stand-alone Hand-free Mode Operating Status: Referring to FIG. 5, the light emitting module is flipped over and unfolded to disengage from the buckles, and then rotated and flipped until the light emitting module forms 90 degrees with the lamp body. At the same time, the hook is swung open to form 90 degrees with the lamp body. Under the blockage of the stopper and with the use of the hook, the light forms a stand-alone mode, the LED main light element facing the hook, forming a desk lamp for use. In addition, the position of the LED main light element can be adjusted by rotating the light emitting module so as to apply to different working environments and fulfill the needs of various angles of illumination.

Figure 6:
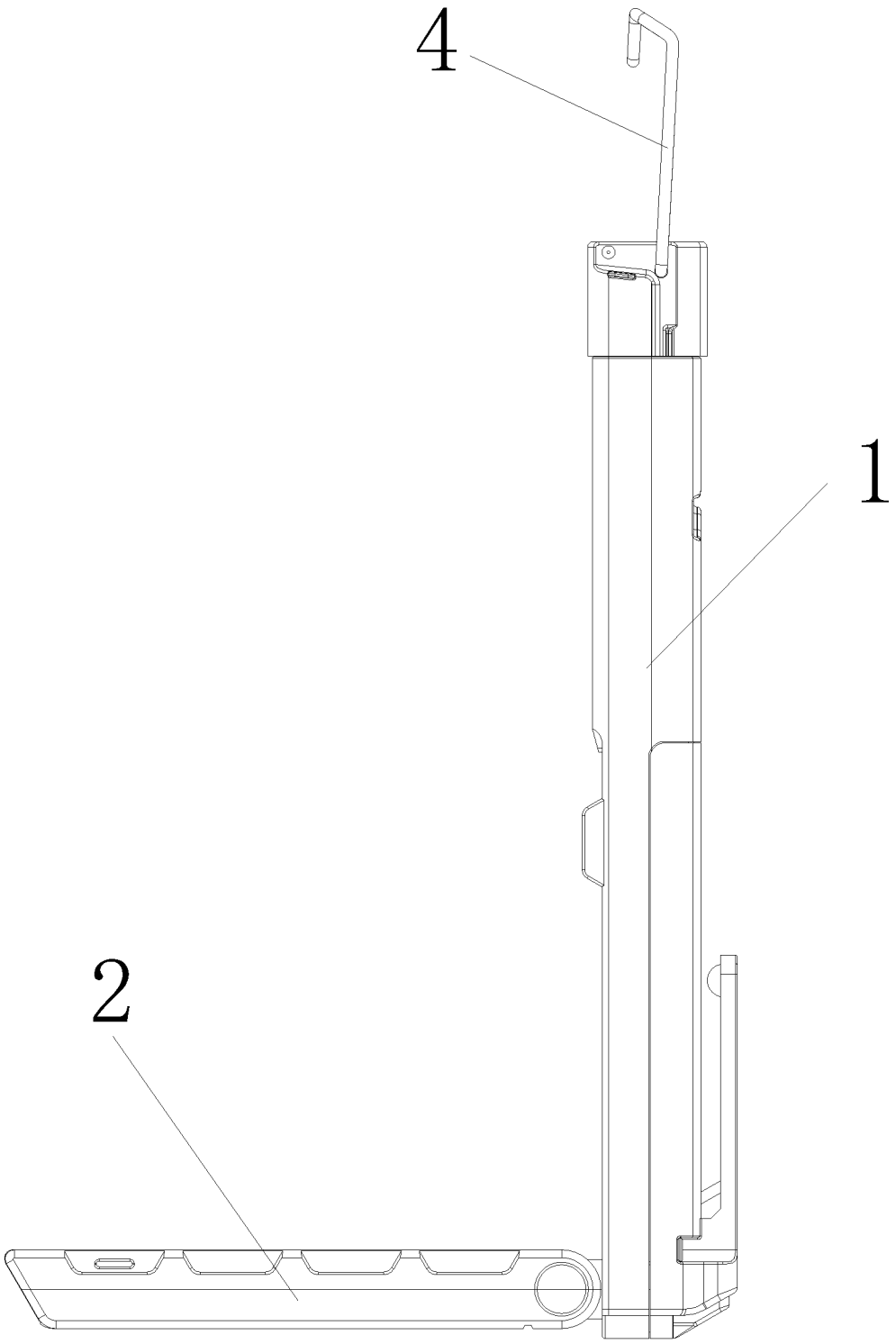
FIG. 6 is a schematic front view of the pocket LED light of the present application in a hanging hand-free mode.

Hanging Hand-free Mode Operating Status: Referring to FIG. 6, the light emitting module is flipped over and unfolded to disengage from the buckles, and then rotated until the light emitting module forms 90 degrees with the lamp body. At the same time, the hook is swung open to form 180 degrees with the lamp body. With the use of the hook, the light forms a hanging mode and can be hung for use, such as outdoor camping.

The present application is directed to a work light which includes a cylindrical body 1 coupled to a power supply 100. The light emitting module 2 is connected to a top portion of the cylindrical body 1 by a rotating shaft 6. As shown in FIG. 1, the rotating shaft 6 is disposed about a lateral side surface of the cylindrical body 1 and allows the light emitting module 2 to be positioned so that the lateral side surface of the cylindrical body 1 and light emitting module 2 are adjacent. The light emitting module 2 comprises a first light source 8 disposed on the exterior lateral side of the light emitting module 2 and a second light source 9 disposed on the distal end of the light emitting module 2, which is opposite the rotating shaft 6. A power switch is disposed about the surface of the cylindrical body 1. The side of the cylindrical or lamp body 1 is opposite the light emitting module 2 and comprises an opening with a rear cover 5 and a pen clip 3 on the rear cover 5. The first and second light sources comprise LEDs. The position of the light emitting module 2 is adjustable in a plurality of configurations with respect to the cylindrical body 1.

As shown in FIG. 1, in accordance with one aspect of the technology, the light emitting module 2 comprises a first configuration wherein a longitudinal axis of the light emitting module 2 is parallel to a longitudinal axis of the cylindrical body 1 and a lateral side surface of the light emitting module 2 is adjacent a lateral side surface of the cylindrical body 1.

In another aspect of the technology, a second configuration is disclosed (see, e.g., FIG. 3) wherein the longitudinal axis of the light emitting module 2 is normal to the longitudinal axis of the cylindrical body 1 and the lateral side surface of the light emitting module 2 is spaced apart from the lateral side surface of the cylindrical body 1.

In another aspect of the technology, a third configuration is shown (see, e.g., FIG. 4) wherein the longitudinal axis of the light emitting module 2 is parallel to the longitudinal axis of the cylindrical body 1 and the lateral side surface of the light emitting module 2 is spaced apart from the lateral side surface of the cylindrical body 1.

In one aspect of the technology, the lateral side surface of the light emitting module 2 and the lateral side surface of the cylindrical body 1 are planar. When the work light is in the first configuration (FIG. 1), the planar lateral side surface of the light emitting module 2 and the planar lateral side surface of the cylindrical body 1 are in contact with one another. When the work light is in the third configuration (FIG. 4), the planar lateral side surface of the light emitting module 2 and the planar lateral side surface of the cylindrical body 1 are not in contact with one another.

In one aspect, the direction of light emitted from the second light source 9 in the first configuration is parallel with the direction of light emitted from the second light source 9 in the third configuration. In another aspect, the direction of light from the second light source 9 in the first configuration is in an opposing direction to the direction of light emitted from the second light source 9 in the third configuration. In yet another aspect, the direction of light emitted from the first light source 8 in the first configuration is parallel with, and in the same direction as, the direction of light from the first light source 8 in the third configuration.

The first and second light sources are provided in an upper cover 20 and a lower cover 21 of the light emitting module 2. The first light source comprises a PCB circuit board 81, a COB light source 82 electrically connected with the PCB circuit board 81 and a reflective cup 83 provided above the COB light source 82. The reflective cup 83 is located below the upper cover 20 and a transparent cover 22 is provided on the upper cover 20 at a position corresponding to the reflective cup 83. The second light source is mounted on the face of a protruding end of the light emitting module 2 comprising an LED and a lens 92. The LED of the second light source is electrically connected with the PCB circuit board 81.

In another aspect of the technology, the work light further comprises a tab extending outward from the lateral side surface of the cylindrical body 1. A recess is disposed in a lateral side surface of the light emitting module 2, which is configured to mate with the tab extending outward from the cylindrical body 1. In another aspect, the work light further comprises a clip 3 that is disposed about the side surface of the cylindrical body 1 opposite the rotating shaft 6 and a pivoting stand disposed distally from the clip 3 on the opposite distal end of the cylindrical body 1.

What is claimed is:

1. A work light, comprising:

a cylindrical body coupled to a power supply;

a light emitting module connected to a top portion of the cylindrical body by a rotating shaft, said rotating shaft disposed about a lateral side surface of the cylindrical body allowing the lighting emitting module to be positioned so that lateral side surface of the cylindrical body and lighting emitting module are adjacent;

wherein the light emitting module comprises a first light source disposed on an exterior lateral side of the light emitting module and a second light source disposed on distal end of the light emitting module opposite the rotating shaft;

a power switch disposed about a surface of the cylindrical body;

wherein the position of the light emitting module is adjustable in a plurality of configurations with respect to the cylindrical body and wherein the light emitting module comprises:

(i) a first configuration wherein a longitudinal axis of the light emitting module is parallel to a longitudinal axis of the cylindrical body and a lateral side surface of the light emitting module is adjacent a lateral side surface of the cylindrical body, (ii) a second configuration wherein the longitudinal axis of the light emitting module is normal to the longitudinal axis of the cylindrical body and the lateral side surface of the light emitting module is spaced apart from the lateral side surface of the cylindrical body, and (iii) a third configuration wherein the longitudinal axis of the light emitting module is parallel to the longitudinal axis of the cylindrical body and the lateral side surface of the light emitting module is spaced apart from the lateral side surface of the cylindrical body, wherein a direction of light emitted from the second light source in the first configuration is parallel with a direction of light emitted from the second light source in the third configuration and wherein the direction of light from the second light source in the first configuration is in an opposing direction to the direction of light from emitted form the second light source in the third configuration.

2. The work light of claim 1, wherein a side of the lamp body opposite the light emitting module comprises an opening provided with a rear cover and a pen clip on the rear cover.

3. The work light of claim 1, wherein the first and second light sources comprise LEDs.

4. The work light of claim 1, wherein the lateral side surface of the light emitting module and the lateral side surface of the cylindrical body are planar.

5. The work light of claim 4, wherein when the work light is in the first configuration, the planar lateral side surface of the light emitting module and the planar lateral side surface of the cylindrical body are in contact with one another.

6. The work light of claim 4, wherein when the work light is in the third configuration, the planar lateral side surface of the light emitting module and the planar lateral side surface of the cylindrical body are not in contact with one another.

7. The work light of claim 1, wherein a direction of light emitted from the first light source in the first configuration is parallel with, and in the same direction as, a direction of light from the first light source in the third configuration.

8. The work light of claim 3, wherein the first and second light sources are provided in an upper cover and a lower cover of the light emitting module, the first light source comprising a PCB circuit board, a COB light source electrically connected with the PCB circuit board, and a reflective cup provided above the COB light source;

wherein the reflective cup is located below the upper cover and a transparent cover is provided on the upper cover at a position corresponding to the reflective cup; and wherein second light source is mounted on the face of a protruding end of the light emitting module comprises an LED and a lens, the LED of the second light source being electrically connected with the PCB circuit board.

9. The work light of claim 1, further comprising a tab extending outward from a lateral side surface of the cylindrical body; and a recess disposed in a lateral side surface of the light emitting module configured to mate with the tab extending outward from the cylindrical body.

10. A work light, comprising:

a cylindrical body housing a power supply and coupled to a power switch;

a light emitting module connected to a top portion of the cylindrical body by a rotating shaft, said rotating shaft disposed about a lateral side surface of the cylindrical body;

wherein the light emitting module comprises a first light source disposed on an exterior lateral side of the light emitting module and a second light source disposed on distal end of the light emitting module opposite the rotating shaft; and wherein the light emitting module is configurable in a plurality of positions comprising:

(i) a first configuration wherein a longitudinal axis of the light emitting module is parallel to a longitudinal axis of the cylindrical body and a lateral side surface of the light emitting module is adjacent a lateral side surface of the cylindrical body, (ii) a second configuration wherein the longitudinal axis of the light emitting module is parallel to the longitudinal axis of the cylindrical body and the lateral side surface of the light emitting module is spaced apart from the lateral side surface of the cylindrical body, wherein a direction of light emitted from the second light source in the first configuration is parallel with a direction of light emitted from the second light source in the second configuration and wherein the direction of light from the second light source in the first configuration is in an opposing direction to the direction of light emitted from the second light source in the second configuration.

11. The work light of claim 10, further comprising (i) a clip disposed about a side surface of the cylindrical body opposite the rotating shaft and (ii) a pivoting stand disposed distally from the clip on an opposite distal end of the cylindrical body.

* * * * *